US005589809A

United States Patent [19]

Kogawa et al.

[11] Patent Number: 5,589,809

[45] Date of Patent: Dec. 31, 1996

[54] THERMAL OVERLOAD RELAY WITH MIS-READJUSTMENT PREVENTING DEVICE

[75] Inventors: Kuniyuki Kogawa; Koetsu Takaya, both of Kawasaki, Japan

[73] Assignee: Fuji Electric Co., Ltd., Kawasaki, Japan

[21] Appl. No.: 399,990

[22] Filed: Mar. 7, 1995

[30] Foreign Application Priority Data

Mar. 15, 1994 [JP] Japan ..... 6-043472

[51] Int. Cl.[6] ..... H01H 61/00

[52] U.S. Cl. ..... 337/36; 337/37

[58] Field of Search ..... 337/36, 158, 14, 337/49, 380, 37; 70/158, 182; 404/25; D8/331

[56] References Cited

U.S. PATENT DOCUMENTS 4,986,097 1/1991 Derman ..... 70/158

5,224,514 7/1993 Taylor ..... 138/89

*Primary Examiner*—Michael W. Phillips
*Assistant Examiner*—Jayprakash N. Grandhi
*Attorney, Agent, or Firm*—Kanesaka & Takeuchi

[57] ABSTRACT

A thermal overload relay is formed of a case for retaining the relay and having an insertion hole, an adjusting device for adjusting a working current of the relay and situated inside the insertion hole, and a cover for covering the adjusting device and situated in the insertion hole. The case includes a first coupling device formed around the insertion hole. The cover is formed of a transparent plate and includes a smooth upper surface, a second coupling device formed on a side surface and engageable with the first coupling device, and a handle formed on the upper surface of the cover for handling the cover. When the cover is disposed in the insertion hole, the first and second coupling devices are engaged, wherein the upper surface of the cover is located below an upper surface of the case. The cover can be fixed to the case such that the cover can be removed from the case or permanently fixed to the case.

9 Claims, 4 Drawing Sheets

THERMAL OVERLOAD RELAY WITH MIS-READJUSTMENT PREVENTING DEVICE

BACKGROUND OF THE INVENTION AND RELATED ART STATEMENT

The present invention relates to an adjusting dial of a thermal overload relay for adjusting a working current of the thermal overload relay, and, more specifically, the present invention relates to a structure of the relay which prevents an adjusting dial previously set from being mis-readjusted.

A thermal overload relay (hereinafter simply referred to as "relay") uses a bimetal plate for detecting an overload. The coupling length of a latch released by the thermal deformation of the bimetal plate is adjustable according to a kind of a load to facilitate adjustment of time from the start of flow of an overload current through the load until the disconnection of the load from its power supply. When the latch is released, a switch mechanism of the relay which has been in a waiting condition starts operating to switch on or off the relay contacts. As a result, an electromagnet of an electromagnetic contactor or an electromagnetic switch inserted in a main circuit in series with the relay is excited, and a main circuit current is interrupted. The coupling length of the latch is adjusted by an adjusting dial. Usually, a circular plate is fixed eccentrically to an end of a shaft of the adjusting dial. The coupling length of the circular plate and the latch placed at a predetermined position inside a relay case at a no-load condition is adjusted by rotating an angle of the adjusting dial.

FIGS. 8, 9(*a*) and 9(*b*) show a structure around the adjusting dial for preventing the adjusting dial from being mis-operated or mis-readjusted according to the prior art. In FIGS. 9(*a*) and 9(*b*), an adjusting dial 4 is positioned inside an adjusting dial mounting hole 4*c* of a case of a relay 1, and overload current values are graduated on the adjusting dial 4. A working current of the relay 1 determined by an overload current and a kind of the load is set by setting a corresponding mark of the overload current on the adjusting dial 4 to a dial setting mark 2*b*. The dial setting mark 2*b* is marked on an indication cover 2, on which a type of the relay, terminal symbols, etc. are stamped or printed. If the graduation setting is changed without notice, for example at a time of routine inspection, the relay may not operate or mis-operate when necessary and trouble may be caused in the equipment. In some relays which require high operation reliability, the adjusting dial 4 is covered by a dial cover 8 so that the adjusting dial can not be turned after setting. An example of the dial cover 8 is shown in FIG. 8, wherein the dial cover 8 with an engaging portion 8*a* is fitted into an adjusting dial insertion hole 2a of the indication cover 2 with a coupling protrusion 2*c* on the inner peripheral edge thereof.

In the above described prior art, the dial cover 8 may be easily removed with a usual tool as shown in FIG. 10 when a worker tries to operate the adjusting dial by misunderstanding.

To meet the requirement that the adjusting dial 4 previously set will never be operated again, following measures have been taken.

(1) The operating hole 4*a* of the adjusting dial 4 is filled with resin, and the adjusting dial 4 is fixed to the case with the resin.

(2) The dial cover 8 is bonded to the indication cover 2 in a manner that the dial cover 8 will never be removed.

However, as the resin, two-liquid resin is often used in the above case, wherein before using the two-liquid resin, two kinds of resin liquids have to be mixed. Thus, there are following drawbacks.

(a) It takes time to mix two kinds of resin liquids.

(b) It takes about a day before the filled resin completely hardens.

(c) Since the resin once mixed hardens naturally, the mixed resin can not be stored.

These drawbacks cause labor to satisfy the requirements to thereby increase cost. Moreover, it can not meet a requirement of quick installment of the relay.

In view of the foregoing, an object of the present invention is to provide a thermal overload relay having a structure which facilitates removal of a dial cover when necessity of readjustment of an adjusting dial of the relay is confirmed, and which prevents the dial cover from being removed when the adjusting dial shall never be readjusted.

SUMMARY OF THE INVENTION

In a first aspect of the present invention, a thermal overload relay is formed of an adjusting dial for adjusting a working current of the relay, and a dial cover for covering the adjusting dial, which is made of a transparent plate for preventing mis-operation of the dial. The dial cover is thick at a periphery thereof, and is formed to have a flat or smoothly curved upper surface. A case of the relay includes an insertion hole, through which the adjusting dial is inserted. The dial cover has the thickness such that in case the dial cover is inserted into the insertion hole, second coupling means formed on an outer periphery of the dial cover engages first coupling means formed on an inner periphery of the insertion hole, and the dial cover is completely located inside the insertion hole without projecting outwardly from the case. The dial cover is also provided with a handle on the outer surface for removing the cover from the case.

In a second aspect of the invention, it is preferable that the dial cover is shaped such that the handle formed on the cover at the opposite side of the dial is cuttable along the outer surface thereof.

In a third aspect of the invention, it is preferable to provide the relay case with latching means adjacent to the insertion hole of the case for latching the handle to the case. It is preferable to provide the handle and the latching means with through holes, slits or bending portions, through which the handle and the latching means are tightly connected together by a wire. Consequently, the dial cover can be fixed to the case.

Instead of forming the through hole, slit or bending portion to the handle, the handle may be formed in a shape such that the handle can not be held easily by hand, and is provided with a hole, into which a tool for removing the cover is inserted.

According to the first aspect of the invention, in case the shape and the structure of the handle are selected, it is possible to substantially prevent removal of the dial cover. In this case, the cover may be removed when it is necessary, or it is possible to completely prevent removal of the cover.

According to the second aspect, the handle may be cut from the root or bottom along the outer surface of the cover. By cutting the handle at the root, the cover is fixed almost permanently to the relay without applying adhesive resin, because the cover can not be removed any more with any usual tool. Readjustment of the dial can be easily prevented.

According to the third aspect of the invention, wherein the relay case is provided with the latching means for latching the handle to the relay case, the latching means and the handle are generally connected by a wire. Thus, it provides an attention to a worker when the worker tries to unnecessarily adjust the dial, and it encourages the worker to confirm whether the readjustment of the dial is really necessary or not. Thus, the latched handle and the latching means prevent the adjusted dial from being readjusted when the readjustment should not be conducted. However, after confirmation, the handle can be easily released from the latching means by removing the wire, and the cover can be easily removed from the relay case.

For example, in case the load attached to the main circuit in which the relay is inserted is formed of a plurality of electric motors, and the number of operation of the motors changes seasonally, this mis-readjustment preventing structure works effectively.

In case the handle is formed in a shape such that the handle can not be held easily by hand and is provided with a hole, into which a tool for removing the cover is inserted, the hole is made to have a specific shape, such as a circular groove, to which only a specific tool for exclusive use fits. Thus, the cover can be removed, if necessary, with the exclusive tool.

Thus, the simple structure according to the present invention prevents the thermal overload relay from being mis-readjusted.

BRIEF DESCRIPTION OF THE DRAWINGS

FIG. 5(*b*) shows a sectional view of the dial cover coupled with an adjusting dial insertion hole of the relay case;

FIG. 6(*b*) shows an enlarged perspective view of the handle of FIG. 6(*a*);

FIG. 9(*b*) shows a perspective view of the thermal overload relay with the main part as shown in FIG. 9(*a*)

DETAILED DESCRIPTION OF PREFERRED EMBODIMENTS

Now the present invention will be described in detail hereinafter with accompanied drawings which illustrate preferred embodiments of the present invention.

Figure 1:
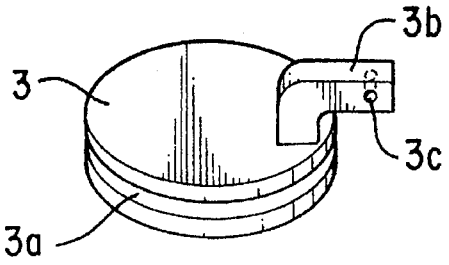
FIG. 1 is a perspective view for showing one embodiment of a dial cover for a thermal overload relay according to the present invention.
Figure 2:
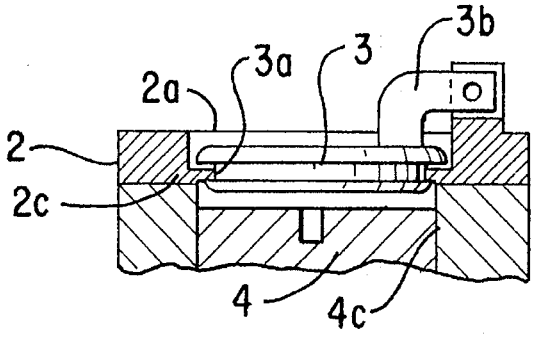
FIG. 2 is a sectional view for showing a main portion of the dial cover of FIG. 1 for explaining the coupling of the dial cover with the relay case.
Figure 3:
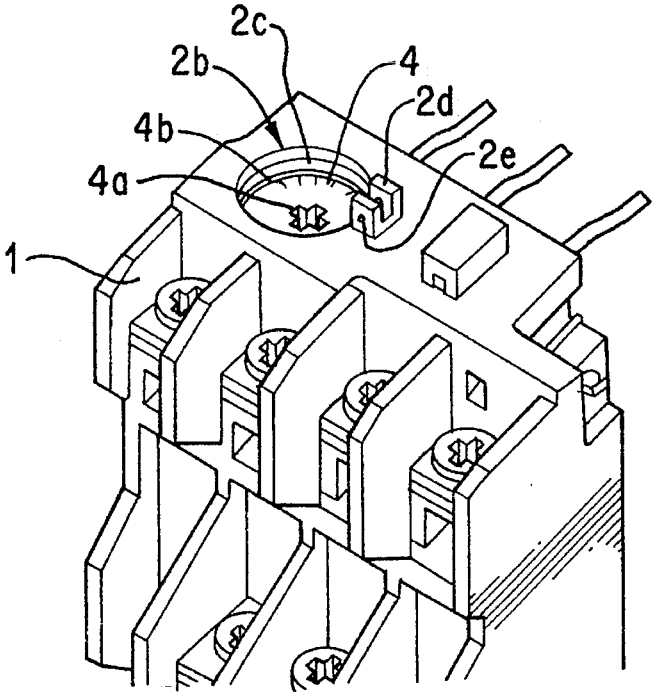
FIG. 3 is a perspective view for showing the adjusting dial mounted on the relay and the main structure for fixing the dial cover to the relay case as shown in FIG. 2.
Figure 4:
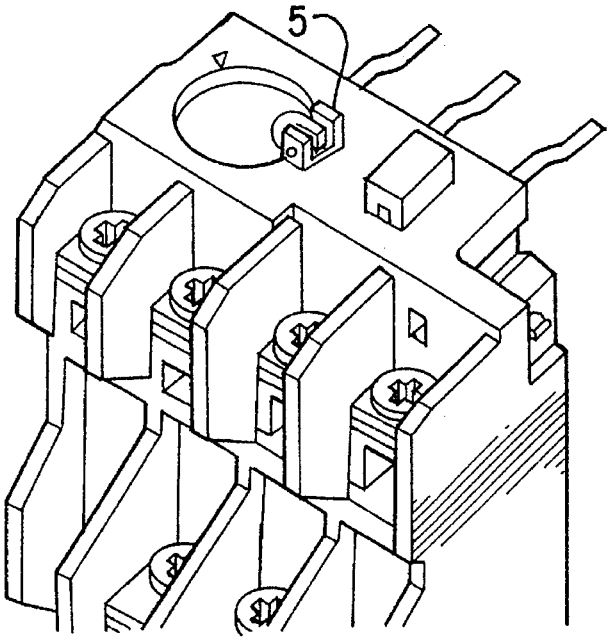
FIG. 4 is a perspective view for showing the dial cover coupled with the relay case as shown in FIG. 1.

The first embodiment is explained with reference to FIGS. 1 through 5. As shown in FIG. 3, an adjusting dial 4 is disposed inside a case of a relay 1, and an upper surface of the adjusting dial 4, on which graduations indicative of working current value of the relay are marked, is positioned below an upper face of the relay case. As shown in FIG. 2, the upper surface of the case is covered with a relatively thick indication cover 2 on which the type code of the relay, terminal symbols, etc. are stamped or printed. An adjusting dial insertion hole 2*a* and an adjusting dial mounting hole 4*c*, through which the adjusting dial 4 is placed inside the case, are formed in the indication cover 2 and the relay 1, respectively. A dial cover 3 made of transparent injection mold resin is formed in a shape of a thick circular plate having a coupling slit 3*a* on a side face of the dial cover 3. An L-shaped handle 3*b* is formed on an upper surface of the dial cover 3, and near the end of the handle 3*b*, a through hole 3*c* is formed through which a metal wire or a pin is inserted.

When the dial 4 placed in the mounting hole 4*c* of the case is covered with the dial cover 3, the dial cover is inserted into the insertion hole 2*a*, and is placed on a coupling protrusion 2*c* protruding inwardly therefrom. Thereafter, the dial cover 3 is pushed toward the dial 4 so as to deform the coupling protrusion 2*c* to thereby couple the slit 3*a* with the coupling protrusion 2*c*. In this example, the coupling protrusion 2*c* is formed in a ring, but it may be formed of a plurality of curved lugs.

Figure 5A:
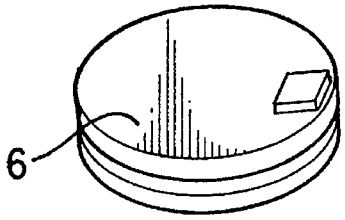
FIG. 5(*a*) shows a perspective view of the dial cover, wherein the handle of the cover has been cut off at its root.
Figure 5B:
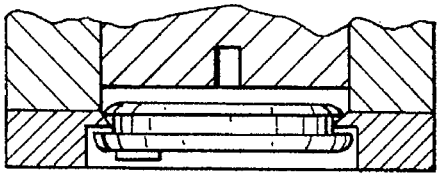

When the once set working current value shall never be changed, the handle 3*b* is cut at its base as shown in FIG. 5(*a*) in advance to coupling the dial cover 3 with the indication cover 2. Once the dial cover 3 is coupled with the indication cover 2, the remainder of the handle 3*c* left on the upper face of the dial cover 3 and the upper face of the dial cover 3 are positioned inside the insertion hole 2*a*. The cover 3 thus set can not be removed, since a tool can not be inserted any more into the coupling slit 3*a*. In this embodiment, the dial cover 3 can not be removed simply by cutting the handle 3*c* at its root even though the dial cover is not bonded.

In a second embodiment, a lug or projection 2*d* is formed on the indication cover 2, and a through hole 2*e* is formed in the lug 2d, as shown in FIGS. 2 and 3. A coupling, for example a coupling slit or a bent head for receiving a head of the handle 3*b*, is formed on the lug 2*d*, or a coupling, for example a coupling slit or a bent head for receiving a head of the lug 2*d*, may be formed on the handle 3*b*. By inserting a wire 5 through the through holes 2*e* and 3*c* and tying up the handle 3*b* and the lug 2*d* with the wire 5, the dial cover 3 is fixed on the indication cover, that is on the relay. Since the latched handle 3*b* and the lug 2*d* are locked, this embodiment facilitates warning to a worker who tries to reset the adjusting dial and encouraging the worker to confirm whether the adjusting dial should really be readjusted or not. When the adjusting dial 4 must be readjusted, the wire 5 is cut to release the handle 3 and the lug 2*d*. Thus, the mis-readjustment can be avoided.

The second embodiment prevents the adjusting dial 4 from mis-operation or mis-readjustment, for example, in a season during which the load of the main circuit containing the relay therein does not change. However, the second embodiment facilitates readjustment of the adjusting dial 4, if necessary, in a season during which the load of the main circuit changes. Thus, the second embodiment facilitates reliable and easy operation of the relay.

Figure 6A:
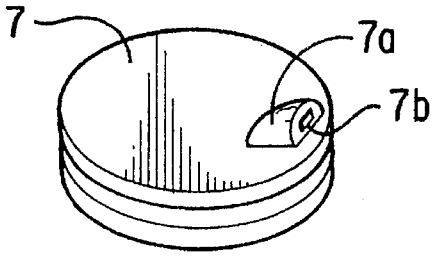
FIG. 6(*a*) shows a perspective view of a different embodiment of the dial cover with the handle of the present invention.
Figure 6B:
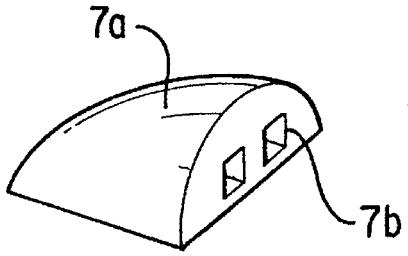
Figure 7:
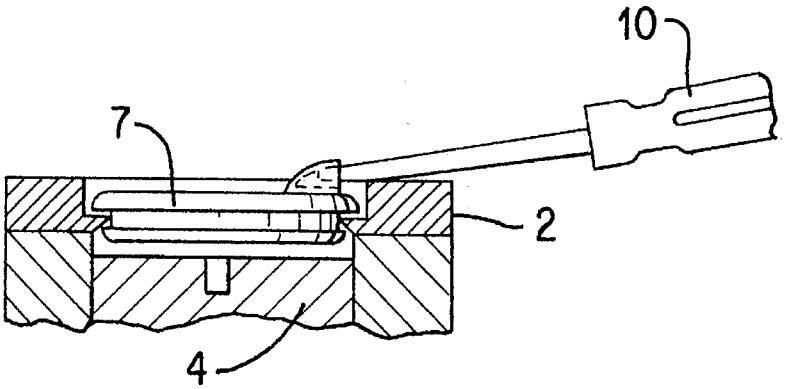
FIG. 7 is a sectional view for showing the dial cover of FIG. 6(*a*) fixed to the relay case and a method of removing the dial cover by an exclusive tool inserted into the hole of the handle.
Figure 8:
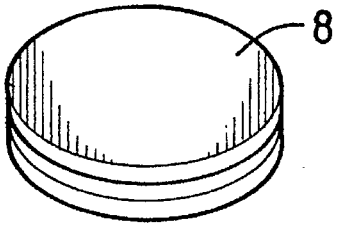
FIG. 8 PRIOR ART
FIG. 8 is a perspective view for showing a dial cover according to the prior art.
Figure 9A:
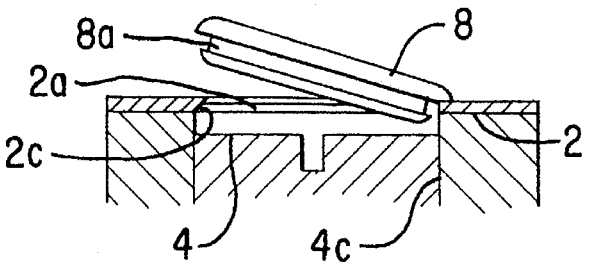
FIG.9(a) PRIOR ART
FIG. 9(*a*) shows a section view of a main part of the dial cover of FIG. 8 on the way of covering the dial insertion hole.
Figure 9B:
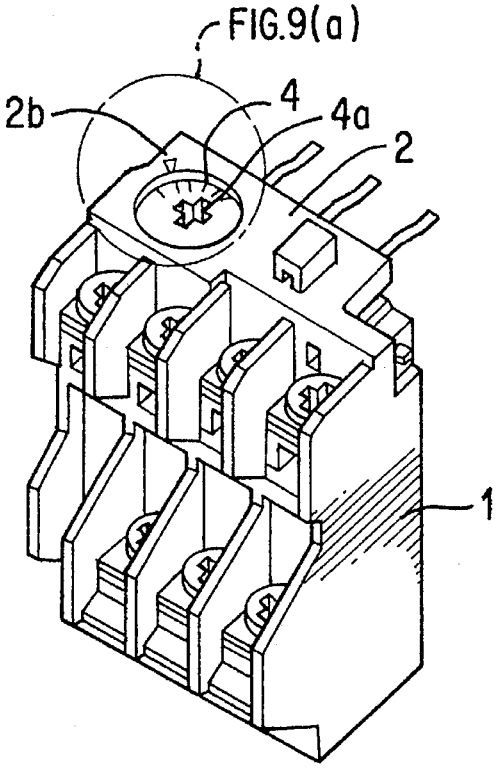
FIG.9(b) PRIOR ART
Figure 10:
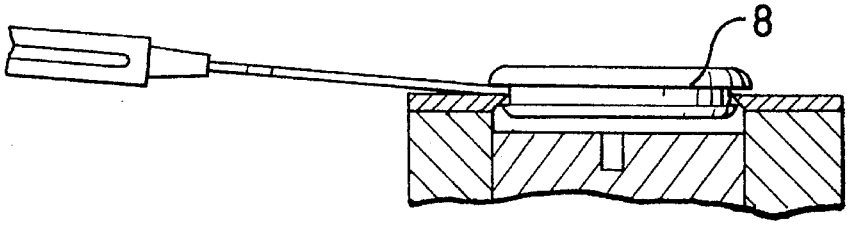
FIG.10 PRIOR ART
FIG. 10 is a sectional view of the dial cover of FIG. 8 for showing removal of the dial cover from the dial insertion hole with a usual tool.

FIG. 6 shows a third embodiment of the present invention. In FIGS. 6(*a*) and 6(*b*), a handle 7*a* formed in a halved dome is formed on an upper surface of a dial cover 7. Holes 7*b* for insertion of an exclusive tool 10 are formed perpendicularly to a vertical plane of the halved dome facing a side face of the dial cover 7. Since the handle 7*a* is formed in a halved dome shape, the handle 7*a* is hard to be held. Also, the holes 7*b* are square holes arranged side by side and are small enough not to allow insertion of usual tools, such as a driver etc. When necessity of readjustment of the adjusting dial is confirmed, the exclusive tool 10 is handed to the worker, by which the dial cover 7 can be opened. When the adjusting dial 4 shall never be readjusted, the handle 7*a* is cut at its root in advance to the installation of the dial cover 7 on the mounting hole 4*c*.

As explained above, a thermal overload relay is comprised of an adjusting dial for adjusting a working current of the relay, and a dial cover for covering the adjusting dial, which is made of a transparent plate for preventing mis-operation or mis-readjustment of the dial. The dial cover is thick at a periphery thereof, and is formed to have a flat or smoothly curved upper surface. A case of the relay includes an insertion hole, through which the adjusting dial is inserted. The dial cover has the thickness such that in case the dial cover is inserted into the insertion hole, second coupling means formed on an outer periphery of the dial cover engages first coupling means formed on an inner periphery of the insertion hole, and the dial cover is completely located inside the insertion hole without projecting outwardly from the case. The dial cover is also provided with a handle on the outer surface for removing the cover from the case. The handle has a specific shape and structure such that removal of the cover is not generally made, and if it is necessary to remove the cover, the cover may be removed from the case. Also, it is possible to completely prevent the removal of the cover. Thus, the reliability of the thermal overload relay is improved according to the demand of the user.

By cutting the handle at its root before the cover is coupled with the case, the cover is fixed to the relay case substantially permanently without using adhesive resin. Therefore, cost increase by extra steps is prevented, and short installation requirement of the relay is met easily.

According to the invention, the relay case is provided with latching means which latches the handle for fixing the cover and the relay case, and the wire tightly connects the handle with the latching means. The latch attracts the worker's attention to encourage confirmation whether the readjustment of the adjusting dial is really necessary or not. Therefore, mis-readjustment of the adjusting means is eliminated, and relay is correctly reset at a working current value corresponding to the load change.

Further, according to the present invention, the handle is formed in a shape which prevents the handle from being held by hand or usual tools. Instead, the handle may be provided with a hole or holes with a specific shape to which only a specific tool for exclusive use fits. A worker can remove the cover only when the specific tool is used, so that mis-readjustment of the dial can be surely prevented. When the necessity of the readjustment is confirmed, the cover can be removed with the exclusive tool. Thus, the readjustment of the working current of the relay is conducted at correct timing.

The simple structure according to the present invention prevents the thermal overload relay from being mis-readjusted and labor and cost from increasing. And, the simple structure according of the present invention facilitates the easy installment of the thermal overload relay.

What is claimed is:

1. A thermal overload relay comprising:

a case for retaining a relay, said case having an insertion hole and first coupling means formed around the insertion hole;

means for adjusting a working current of the relay situated inside the insertion hole; and a cover for covering said adjusting means situated in the insertion hole, said cover being formed of a transparent plate and including a side surface, a smooth upper surface, second coupling means formed on the side surface and engageable with the first coupling means, and a handle formed on the upper surface of the cover for handling the cover and being shaped and made of a material cuttable along the upper surface thereof, said cover, when disposed in the insertion hole to engage the first and second coupling means, being positioned such that the upper surface of the cover is located below an upper surface of the case and the handle projects outwardly from the upper surface of the case.

2. A thermal overload relay as claimed in claim 1, wherein said case further includes latching means formed adjacent to the insertion hole to fix the cover to the case.

3. A thermal overload relay as claimed in claim 2, wherein said case includes a main portion and an indication cover situated on the main portion, said indication cover having the first coupling means and the latching means.

4. A thermal overload relay as claimed in claim 3, wherein said first coupling means is a projection extending into the insertion hole, and said second coupling means is an annular groove formed in the side surface of the cover.

5. A thermal overload relay as claimed in claim 3, further comprising connecting means, said handle further including a through hole and said latching means further including a through hole, said connecting means tightly connecting said handling means with said latching means through the through holes.

6. A thermal overload relay as claimed in claim 5, wherein said latching means further includes a depression, said handle being disposed in the depression.

7. A thermal overload relay as claimed in claim 1, wherein said handle includes a vertical portion extending upwardly from the upper surface of the case and a lateral portion extending from the vertical portion onto the upper surface of the case laterally beyond the upper surface of the cover, and said case includes latching means situated on the upper surface of the case adjacent to the insertion hole, said latching means having a slit for receiving the lateral portion of the handle so that when the lateral portion of the handle is disposed in the slit, the cover is fixed in the case.

8. A thermal overload relay as claimed in claim 7, further comprising a pin, said lateral portion and said latching means having holes therein so that when the lateral portion is situated in the slit and the pin is inserted into the holes, the handle and the case are immovably held together.

9. A thermal overload relay comprising:

a case for retaining a relay, said case having an insertion hole and first coupling means formed around the insertion hole;

means for adjusting a working current of the relay situated inside the insertion hole; and a cover for covering said adjusting means situated in the insertion hole, said cover being formed of a transparent plate and including a side surface, a smooth upper surface, second coupling means formed on the side surface and engageable with the first coupling means, and a handle formed on the upper surface of the cover for handling the cover, said cover, when disposed in the insertion hole to engage the first and second coupling means, being positioned such that the upper surface of the cover is located below an upper surface of the case, said handle having at least one hole at one side thereof, said hole having a shape such that a tool exclusive for removing the cover can only be inserted.

* * * * *

UNITED STATES PATENT AND TRADEMARK OFFICE

CERTIFICATE OF CORRECTION

PATENT NO. : 5,589,809

DATED : December 31, 1996

INVENTOR(S) : Kuniyuki Kogawa, Kouetsu Takaya

It is certified that error appears in the above-indentified patent and that said Letters Patent is hereby corrected as shown below:

The cover page, inventors' section, change "Koetsu Takaya" to -- Kouetsu Takaya--.

Signed and Sealed this

Twenty-fifth Day of February, 1997

Bruce Lehman

*Attest:*

BRUCE LEHMAN

*Attesting Officer*

*Commissioner of Patents and Trademarks*